US007600279B1

(12) United States Patent
Cameron

(10) Patent No.: US 7,600,279 B1
(45) Date of Patent: Oct. 13, 2009

(54) BEDSPREAD SYSTEM

(76) Inventor: Minda C. Cameron, 6945 Hibiscus Ave., S. Pasadena, FL (US) 33707

( * ) Notice: Subject to any disclaimer, the term of this patent is extended or adjusted under 35 U.S.C. 154(b) by 0 days.

(21) Appl. No.: 12/148,652

(22) Filed: Apr. 21, 2008

(51) Int. Cl.
*A47G 9/02* (2006.01)

(52) U.S. Cl. ..... 5/482; 5/486; 5/490

(58) Field of Classification Search ..... 5/482, 5/486, 490, 907
See application file for complete search history.

(56) References Cited

U.S. PATENT DOCUMENTS 3,295,150 A * 1/1967 Shapiro et al. ..... 5/482
4,815,156 A * 3/1989 Williams ..... 5/485
5,118,553 A * 6/1992 Boisson ..... 428/99
5,438,719 A * 8/1995 Anthony ..... 5/485
6,049,925 A * 4/2000 Lewis ..... 5/497
6,496,992 B2 * 12/2002 Saparow ..... 5/482

* cited by examiner

*Primary Examiner*—Michael Trettel

(57) ABSTRACT

A body portion has a top and a bottom surface, a head edge and a foot edge. Top and bottom surfaces are separated by a length. The side edges are separated by a width. A head portion has a top and a bottom surface, a head edge and a foot edge. The top and bottom surfaces are separated by a length. The side edges are separated by a width. Coupling components couple the top edge of the body portion and the bottom edge of the head portion. A cutout is formed in each side edge. The cutouts form positioning guides. In this manner the user is assisted in the proper placement of the bedspread upon the mattress. Further in this manner the positioning guides on the mattress are adjacent to the ends of the head end of the upper surface of the mattress.

8 Claims, 4 Drawing Sheets

BEDSPREAD SYSTEM

BACKGROUND OF THE INVENTION

Field of the Invention

The present invention relates to a bedspread system and more particularly pertains to assisting a user in making up a bed in a convenient, repeatable and simplified manner.

SUMMARY OF THE INVENTION

In view of the foregoing disadvantages inherent in the known types of bedding of known designs and configurations now present in the prior art, the present invention provides an improved bedspread system. As such, the general purpose of the present invention, which will be described subsequently in greater detail, is to provide a new and improved bedspread system and method which has all the advantages of the prior art and none of the disadvantages.

To attain this, the present invention essentially comprises a bedspread system. First provided is a mattress. The mattress is in a rectilinear configuration. The mattress has a planar top face. The mattress has a parallel planar bottom face. The top and bottom faces are separated by a thickness. The mattress has a planar head end. The mattress has a parallel planar foot end. The head and foot ends are separated by a length. The mattress has parallel planar sides. The sides are separated by a width.

A bedspread body portion is provided. The body portion is in a rectangular configuration. The body portion has a top surface. The body portion has a bottom surface. The body portion has a linear head edge. The body portion has a parallel linear foot edge. The head and foot edges are separated by a length. The body portion has parallel linear side edges. The edges are separated by a width.

Provided next is a bedspread head portion. The head portion is in a rectangular configuration. The head portion has a top surface. The head portion has a bottom surface. The head portion has a linear head edge. The head portion has a parallel planar foot edge. The head and foot edges are separated by a length. The head portion has parallel linear side edges. The edges are separated by a width. The length of the body portion is greater than the length of the mattress plus the thickness of the mattress. The width of the body portion is greater than the width of the mattress plus twice the thickness of the mattress. The length of the head portion is less than half the length of the body portion. The width of the head portion is less than the width of the body portion by about 10 percent. The top surface of the body and head portions and the bottom surface of the body portion are of a common tactile characteristic and different than the tactile configuration of the bottom surface of the head portion. The top surface of the body and head portions and the bottom surface of the body portion are preferably quilted. The bottom surface of the head portion is preferably un-quilted. The bottom surface of the head portion is of a visual characteristic different than the visual characteristic of the bottom surface. The visual characteristic of the bottom surface of the head portion is preferably of a distinctive design. The visual characteristic of the bottom surface is preferably of a non-distinctive design. A pillow is provided. In this manner the body portion of the bedspread is placed upon the top of the mattress and the head portion is folded over to cover the pillow. Further in this manner the head portion is tucked under a pillow. The head portion will have a different characteristic than the body portion.

Further provided are coupling components. The coupling components in the preferred embodiment are stitching. The coupling components couple the top edge of the body portion and the bottom edge of the head portion. The coupling components are provided perpendicular to the side edges of the head and body portions. A centerline is provided midway between the coupling components and the head and body portions.

Provided last is a cutout. The cutout is formed in each side edge of the head portion adjacent to the lower edge. Each cutout is in the form of a triangle. The triangle has angles. The hypotenuses extends inwardly toward each other from an associated side edge. The angles remote from the side edge constitute positioning guides. In this manner the user is assisted in the proper placement of the bedspread upon the mattress. Further in this manner the positioning guides on the mattress are adjacent to the ends of the head end of the upper surface of the mattress. This relationship of components is adapted to speed up the making of a bed and to assist less physically capable people in making a bed.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved bedspread system which has all of the advantages of the prior art bedding of known designs and configurations and none of the disadvantages.

It is another object of the present invention to provide a new and improved bedspread system which may be easily and efficiently manufactured and marketed.

It is further object of the present invention to provide a new and improved bedspread system which is of durable and reliable constructions.

An even further object of the present invention is to provide a new and improved bedspread system which is susceptible of a low cost of manufacture with regard to both materials and labor, and which accordingly is then susceptible of low prices of sale to the consuming public, thereby making such bedspread system economically available to the buying public.

Even still another object of the present invention is to provide a bedspread system for assisting a user in making up a bed in a convenient, repeatable and simplified manner.

Lastly, it is an object of the present invention to provide a new and improved bedspread system. A body portion has a top and a bottom surface, a head edge and a foot edge. Top and bottom surfaces are separated by a length. The side edges are separated by a width. A head portion has a top and a bottom surface, a head edge and a foot edge. The top and bottom surfaces are separated by a length. The side edges are separated by a width. Coupling components couple the top edge of the body portion and the bottom edge of the head portion. A cutout is formed in each side edge. The cutouts form positioning guides. In this manner the user is assisted in the proper placement of the bedspread upon the mattress. Further in this manner the positioning guides on the mattress are adjacent to the ends of the head end of the upper surface of the mattress.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
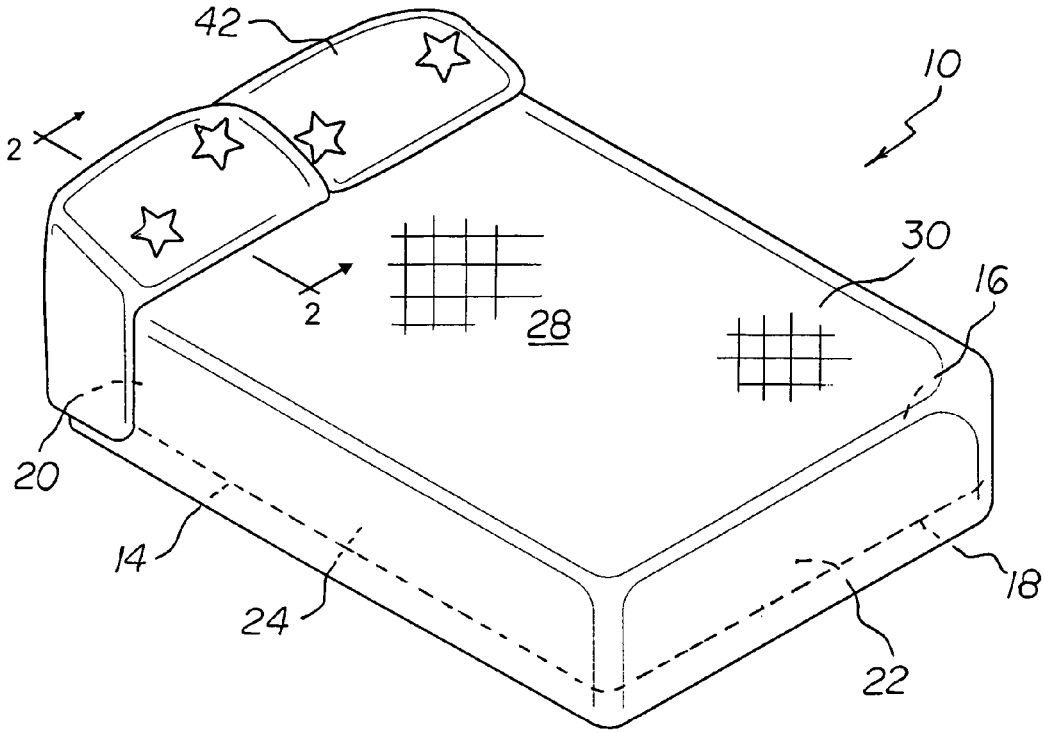
FIG. 1 is a perspective illustration of a bedspread system constructed in accordance with the principles of the present invention.
Figure 2:
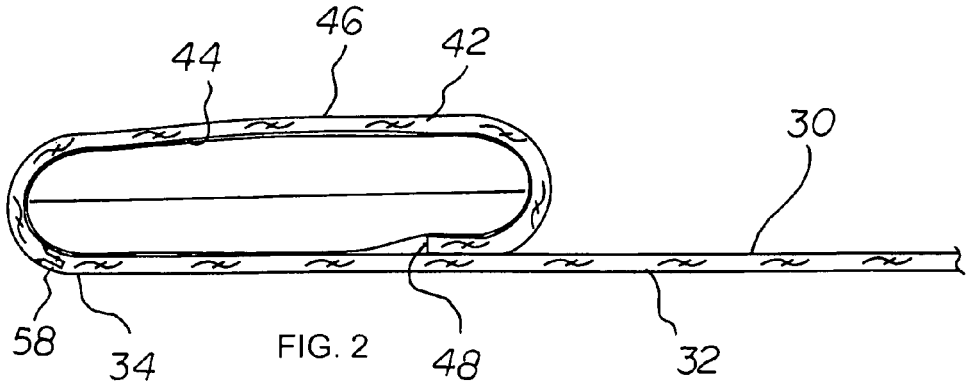
FIG. 2 is a cross sectional view taken along line 2-2 of FIG. 1.
Figures 3, 4:
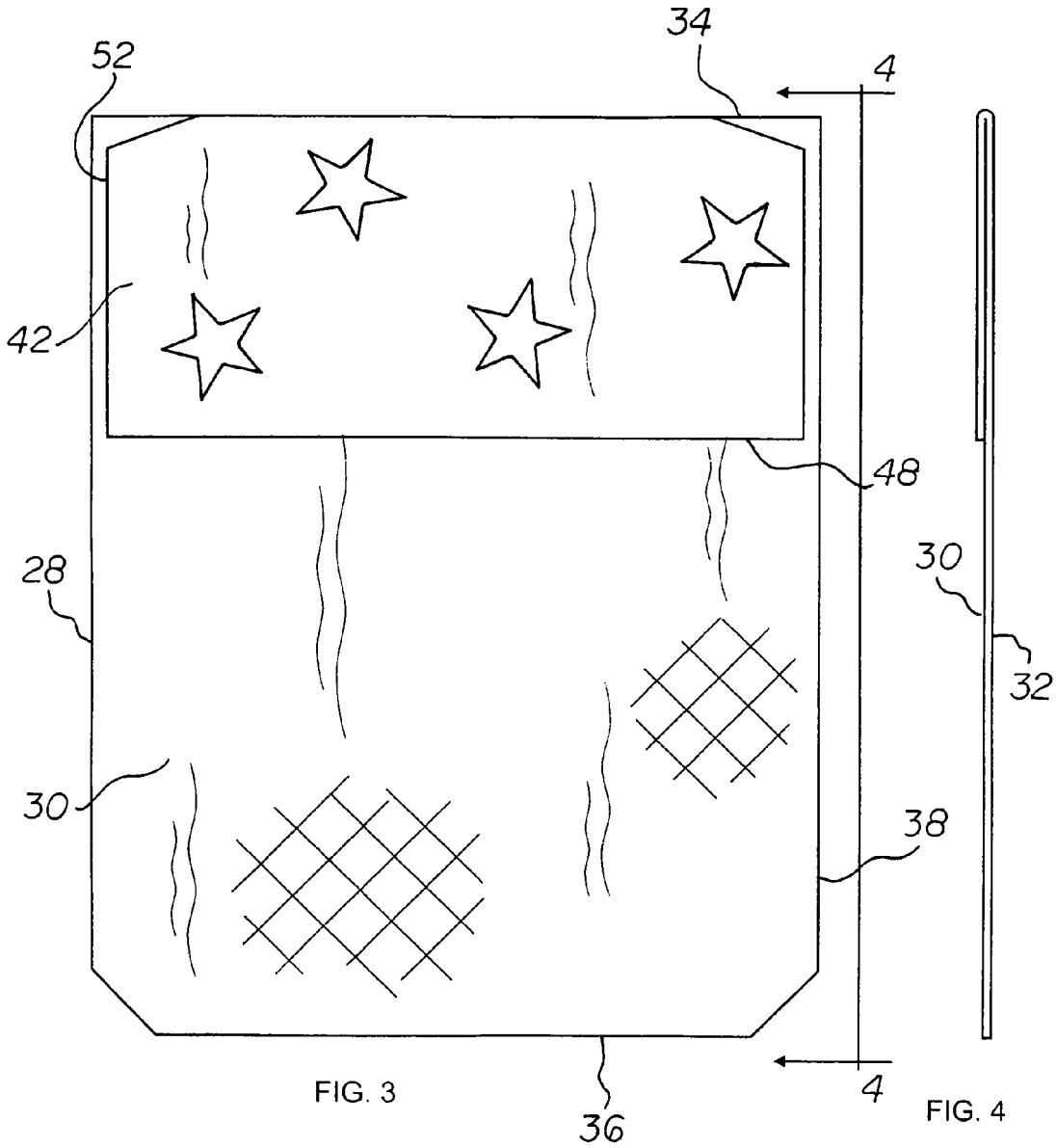
FIG. 3 is a plan view of the bedspread system shown in FIGS. 1 and 2.
FIG. 4 is a side elevational view taken along line 4-4 of FIG. 3.
Figure 5:
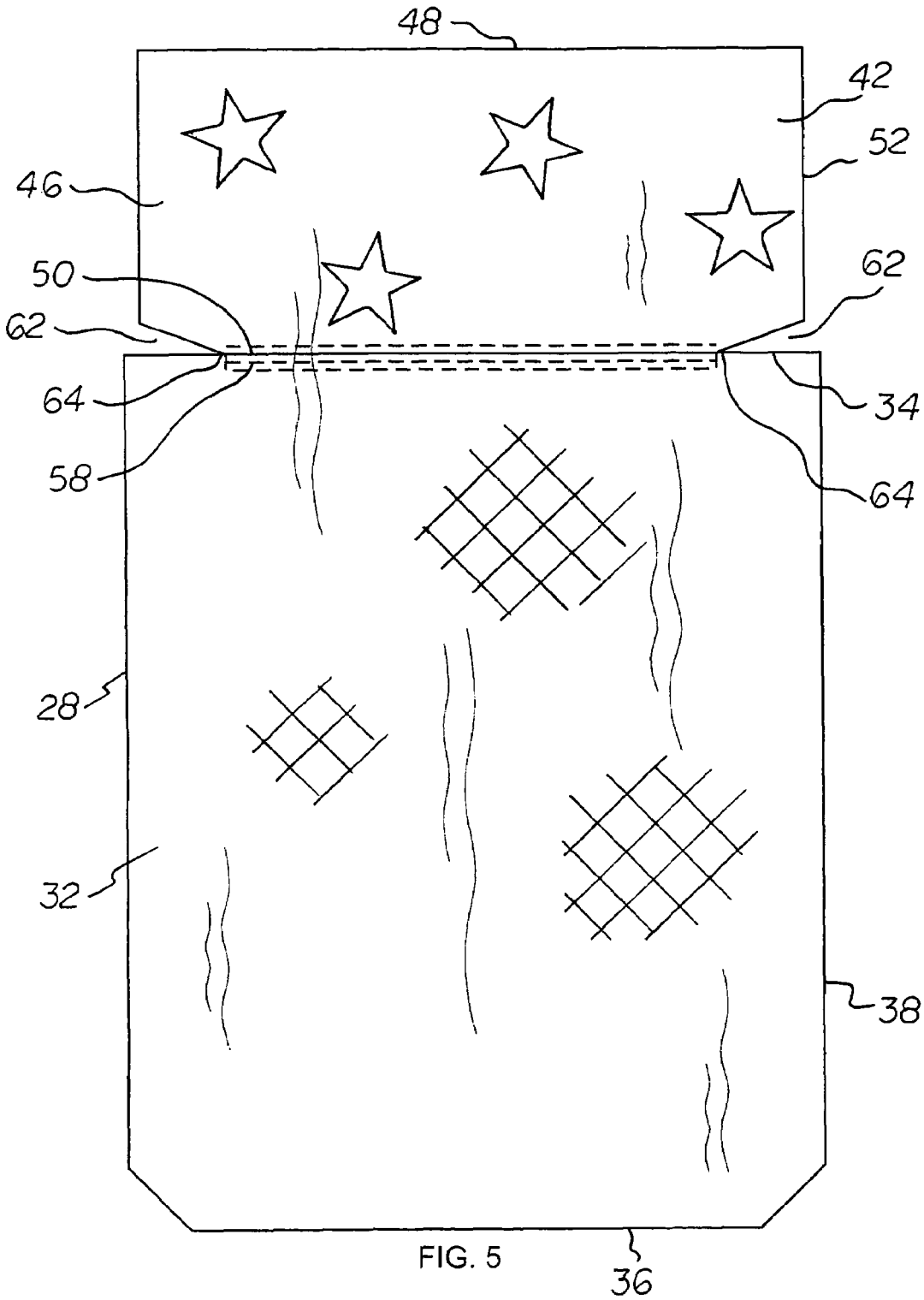
FIG. 5 is a bottom view of the bedspread system shown in FIGS. 1 and 2 prior to placement on a bed.

With reference now to the drawings, and in particular to FIG. 1 thereof, the preferred embodiment of the new and improved bedspread system embodying the principles and concepts of the present invention and generally designated by the reference numeral 10 will be described.

The present invention, the bedspread system 10 is comprised of a plurality of components. Such components in their broadest context include a body portion, a head portion, coupling components and a cutout. Such components are individually configured and correlated with respect to each other so as to attain the desired objective.

First provided is a mattress 14. The mattress is in a rectilinear configuration. The mattress has a planar top face 16. The mattress has a parallel planar bottom face 18. The top and bottom faces are separated by a thickness. The mattress has a planar head end 20. The mattress has a parallel planar foot end 22. The head and foot ends are separated by a length. The mattress has parallel planar sides 24. The sides are separated by a width.

A bedspread body portion 28 is provided. The body portion is in a rectangular configuration. The body portion has a top surface 30. The body portion has a bottom surface 32. The body portion has a linear head edge 34. The body portion has a parallel linear foot edge 36. The head and foot edges are separated by a length. The body portion has parallel linear side edges 38. The edges are separated by a width.

Provided next is a bedspread head portion 42. The head portion is in a rectangular configuration. The head portion has a top surface 44. The head portion has a bottom surface 46. The head portion has a linear head edge 48. The head portion has a parallel planar foot edge 50. The head and foot edges are separated by a length. The head portion has parallel linear side edges 52. The edges are separated by a width. The length of the body portion is greater than the length of the mattress plus the thickness of the mattress. The width of the body portion is greater than the width of the mattress plus twice the thickness of the mattress. The length of the head portion is less than half the length of the body portion. The width of the head portion is less than the width of the body portion by about 10 percent. The top surface of the body and head portions and the bottom surface of the body portion are of a common tactile characteristic and different than the tactile configuration of the bottom surface of the head portion. The top surface of the body and head portions and the bottom surface of the body portion are preferably quilted. The bottom surface of the head portion is preferably un-quilted. The bottom surface of the head portion is of a visual characteristic different than the visual characteristic of the bottom surface. The visual characteristic of the bottom surface of the head portion is preferably of a distinctive design. The visual characteristic of the bottom surface is preferably of a non-distinctive design. A pillow 54 is provided. In this manner the body portion of the bedspread is placed upon the top of the mattress and the head portion is folded over to cover the pillow. Further in this manner the head portion is tucked under a pillow. The head portion will have a different characteristic than the body portion.

Further provided are coupling components 58. The coupling components in the preferred embodiment are stitching. The coupling components couple the top edge of the body portion and the bottom edge of the head portion. The coupling components are provided perpendicular to the side edges of the head and body portions. A centerline is provided midway between the coupling components and the head and body portions.

Provided last is a cutout 62. The cutout is formed in each side edge of the head portion adjacent to the lower edge. Each cutout is in the form of a triangle. The triangle has angles 64. The hypotenuses extends inwardly toward each other from an associated side edge. The angles remote from the side edge constitute positioning guides. In this manner the user is assisted in the proper placement of the bedspread upon the mattress. Further in this manner the positioning guides on the mattress are adjacent to the ends of the head end of the upper surface of the mattress. This relationship of components is adapted to speed up the making of a bed and to assist less physically capable people in making a bed.

Figure 6:
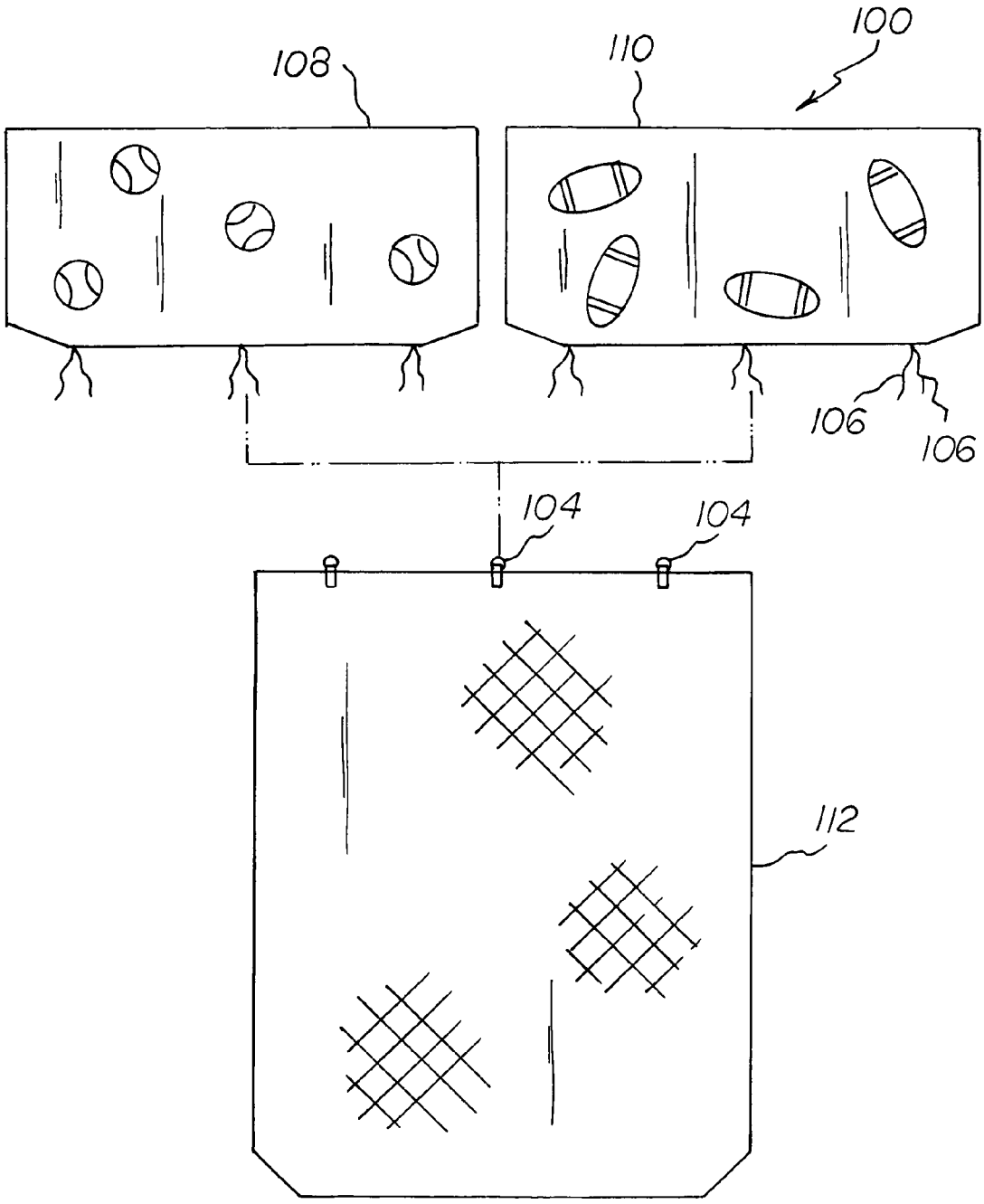
FIG. 6 is a bottom view similar to FIG. 5, but illustrating an alternate embodiment of the invention.

Note the alternate embodiment 100 of FIG. 6. The coupling components include rings 104. The rings are provided adjacent to the lower edge of the head portion. The coupling components include ribbons 106. The ribbons are provided along the upper edge of the body portion. The ribbons are adapted to couple with the rings. In this manner removable coupling between the head and body portions is provided. Other coupling components include snaps, buttons with button holes, hook and loop fasteners, as well as a wide variety of other separable fasteners. Additionally, in such embodiment, a plurality of head portions 108, 110 of different characteristics are provided for removable coupling with a single body portion 112. Such embodiment allows for different seasonal designs, as for example, baseballs in the spring and summer with footballs in the fall and winter.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bedspread system comprising:

a body portion having a top and a bottom surface with a head edge and a foot edge separated by a length with side edges separated by a width;

a head portion having a top and a bottom surface with a head edge and a foot edge separated by a length with side edges separated by a width;

coupling components coupling the head edge of the body portion and the foot edge of the head portion; and a cutout formed in each side edge forming positioning guides for assisting the user in the proper placement of the bedspread upon the mattress with the positioning guides on the mattress adjacent to the ends of the head end of the upper surface of a mattress.

2. The system as set forth in claim 1 wherein the top surface of the body and head portions and the bottom surface of the body portion are of a common tactile characteristic different than a tactile configuration of the bottom surface of the head portion whereby when the body portion of the bedspread is placed upon the top of the mattress and the head portion is folded over to cover a pillow and then tucked under a pillow, the head portion will have a different characteristic than the body portion.

3. The system as set forth in claim 1 wherein the bottom surface of the head portion being of a visual characteristic different than a visual characteristic of the bottom surface whereby when the body portion of the bedspread is placed upon the top of the mattress and the head portion is folded over to cover a pillow and then tucked under a pillow, the head portion will have a different characteristic than the body portion.

4. The system as set forth in claim 1 wherein the coupling components include stitching.

5. The system as set forth in claim 1 wherein the coupling components are separable.

6. The system as set forth in claim 5 wherein the coupling components include rings adjacent to the foot edge of the head portion and ribbons along the head edge of the body portion, the ribbons adapted to couple with the rings for the removable coupling between the head and body portions.

7. The system as set forth in claim 5 and further including:

a plurality of head portions of different characteristics for removable coupling with a single body portion.

8. A bedspread system for assisting a user in making up a bed in a convenient, repeatable and simplified manner comprising, in combination:

a mattress in a rectilinear configuration having a planar top face and a parallel planar bottom face separated by a thickness, the mattress having a planar head end and a parallel planar foot end separated by a length with parallel planar sides separated by a width;

a bedspread body portion in a rectangular configuration having a top surface and a bottom surface, the body portion having a linear head edge and a parallel linear foot edge separated by a length with parallel linear side edges separated by a width;

a bedspread head portion in a rectangular configuration having a top surface and a bottom surface, the head portion having a linear head edge and a parallel planar foot edge separated by a length with parallel linear side edges separated by a width, the length of the body portion being greater than the length of the mattress plus the thickness of the mattress, the width of the body portion being greater than the width of the mattress plus twice the thickness of the mattress, the length of the head portion being less than half the length of the body portion, the width of the head portion being less than the width of the body portion by about 10 percent, the top surface of the body and head portions and the bottom surface of the body portion being of a common tactile characteristic different than a tactile configuration of the bottom surface of the head portion, the bottom surface of the head portion being of a visual characteristic different than a visual characteristic of the bottom surface whereby when the body portion of the bedspread is placed upon the top of the mattress and the head portion is folded over to cover a pillow and then tucked under a pillow, the head portion will have a different characteristic than the body portion;

coupling components coupling the head edge of the body portion and the foot edge of the head portion, the coupling components being perpendicular to the side edges of the head and body portions with a centerline midway between the coupling components and the head and body portions; and a cutout formed in each side edge of the head portion adjacent to the foot edge, each cutout being in the form of a triangle with the hypotenuses extending inwardly toward each other from an associated side edge and with the angles remote from the side edge constituting positioning guides for assisting the user in the proper placement of the bedspread upon the mattress with the positioning guides on the mattress adjacent to the ends of the head end of the upper surface of the mattress.

* * * * *